United States Patent [19]

Horton

[11] 4,308,992

[45] Jan. 5, 1982

[54] METERED-USAGE VARIABLE-VOLUME AIR DISTRIBUTION SYSTEM

[76] Inventor: Donald B. Horton, 4229 Dogwood Ave., Seal Beach, Calif. 90740

[21] Appl. No.: 178,400

[22] Filed: Aug. 15, 1980

Related U.S. Application Data

[63] Continuation-in-part of Ser. No. 54,686, Jul. 5, 1979.

[51] Int. Cl.[3] ..... F24F 7/00

[52] U.S. Cl. ..... 236/49; 165/11 R; 73/193 R; 236/94

[58] Field of Search ..... 165/11, 31; 62/137; 236/94, 49; 73/193 R, 193 A

[56] References Cited

U.S. PATENT DOCUMENTS 3,865,181 2/1975 Mori et al. ..... 165/22
3,995,686 12/1976 Laube ..... 165/11
4,049,044 9/1977 Cohen ..... 165/11
4,221,260 9/1980 Otala et al. ..... 73/193 R

*Primary Examiner*—William E. Wayner
*Attorney, Agent, or Firm*—Robert Louis Finkel

[57] ABSTRACT

A system for apportioning the operating costs of a central, constant-temperature, constant-pressure, variable-volume air conditioning or heating system among its multiple users. Meters at each unit measure the cumulative volume of air received on thermostatically controlled demand by each user's unit during a given period, and the total operating cost for that period is prorated among the users in the proportion that the total volume of air received by each unit bears to the total volume of air used by all of the units during the same period. The total volume used by all of the units may be measured by metering the total volume of air put out by the central delivery system, or determined by taking the sum of the volumes received by all of the units.

9 Claims, 1 Drawing Figure

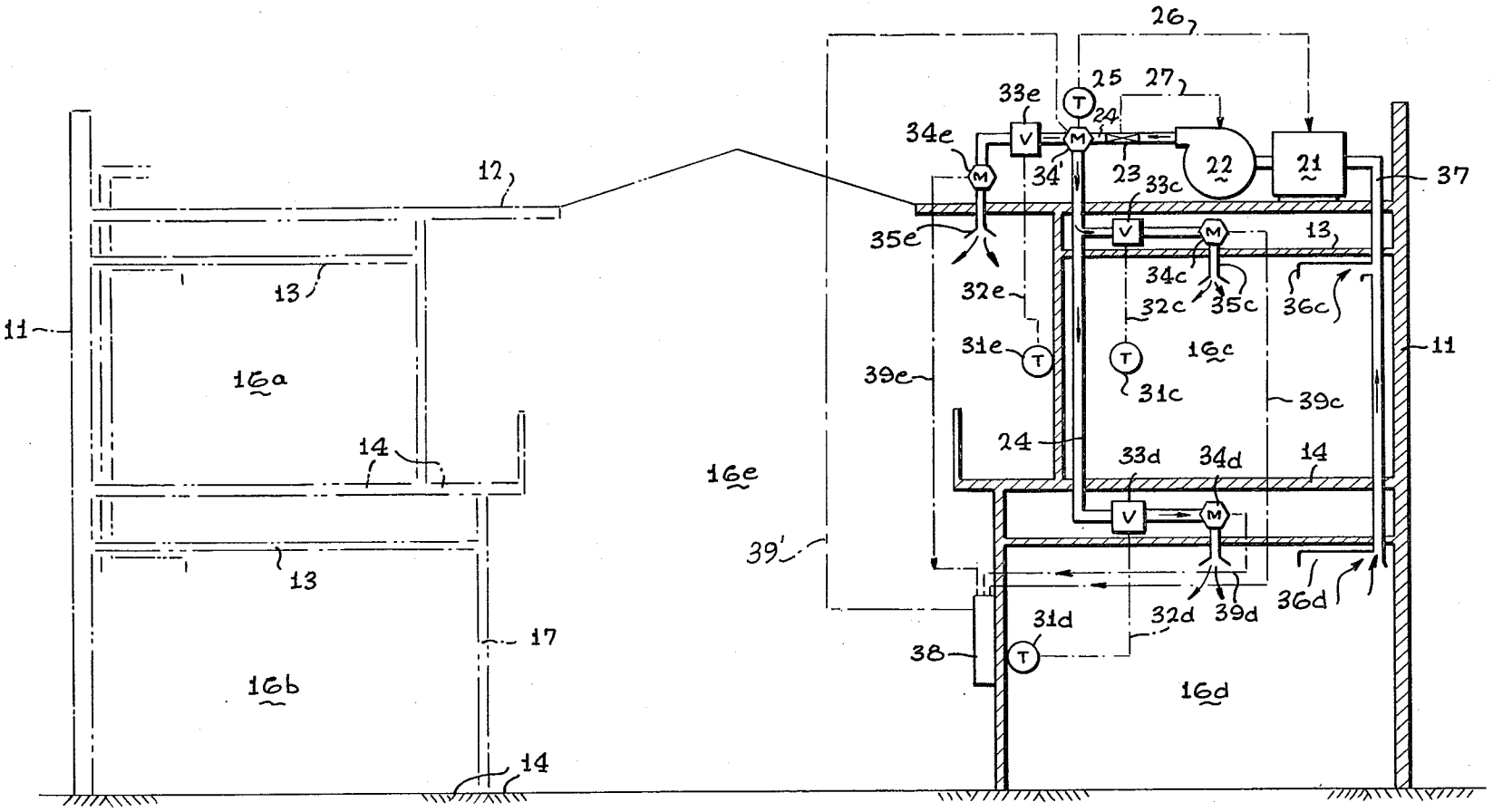
11
37
21
22
26
27
25
24
23
33c
34c
32c
31c
35c
36c
39c
13
14
16c
34d
33d
32d
31d
39d
36d
16d
33e
34e
32e
31e
35e
39e
38
39'
16e
12
17
16a
16b

METERED-USAGE VARIABLE-VOLUME AIR DISTRIBUTION SYSTEM

This is a continuation-in-part of my application Ser. No. 54,686, filed July 5, 1979.

BACKGROUND OF THE INVENTION

1. Field of the Invention

My invention is in the field of heating, ventilating and air-conditioning (cooling) systems.

In particular it relates to central systems for heating, ventilating and cooling buildings having multiple independently managed area modules, among which it is desired to apportion equitably the cost of heating, ventilating and cooling. Typical of buildings having such a requirement are shopping centers incorporating a great variety of types and sizes of business activity, frequently with public areas used in common by all of the businesses, and office buildings, condominia, and apartment buildings utilizing common air-distribution systems.

2. Prior Art

In the past where multiple independent activities have been served by a common cooling or heating unit, problems have arisen as to fairness of apportionment of the cost of operating the unit. Some tenants may wish to keep their areas at a very different temperature than others. Some tenants may have a much greater "heat load" due to people in their areas, or due to high lighting levels, cooking equipment, or other sources which transfer heat to the air in the area. Some tenants may wish to keep large doors in their areas open to the outside, so that significant amounts of the heated or cooled air from the central distribution unit never reach the return duct, and are simply wasted to the out-of-doors.

Formulas for apportioning the cost of operating a cooling or heating unit based on square footage of an area module, or based on number of employees or gross sales or store frontage, obviously will all fail of fairness, because the causes of cooling or heating demand variation described in the previous paragraph are almost completely independent of such arbitrary formulas.

Many designers of large multiple-occupancy buildings, facing this bewildering array of variables, have simply thrown up their hands and provided each tenant with a separate air conditioner and/or heater, so that each tenant controls and pays for his own cooling or heating costs directly. However, this solution to the problem is a poor one for several reasons: (1) the separate units are more costly at purchase than a shared system; (2) most area modules are provided with much larger machines than necessary, since they are selected to accommodate the most extreme demands contemplated for the area module without regard to the type of tenancy; (3) commercial availability of the individual units is subject to considerable fluctuation, often delaying completion of construction; (4) structural mounting provisions for the individual units increase the cost of construction, in comparison with ducting from a central unti; and (5) overall cost of operation, after installation is complete, is higher for the combined individual units than for a common central system.

In installations using radiative heating or cooling systems in which chilled or heated water is circulated through heat exchangers in each area module, designers have attacked the problem by providing meters to monitor the flow and change in temperature of the water passing through each heat exchanger and utilizing these data to prorate the cost of operating the central system. An example of such a system is the ITT Barton "Model 950 BTU Computer," with "Model 392 Electronic Temperature Transmitter" and "series 7000 Turbine Meters." These components are described in Barton's Product Bulletins number 950-1, 392-4 and 7000-5, respectively. This technique cannot be used with variable-volume air distribution systems, since there is no way to measure the increase or decrease in temperature of the air entering each module, or the extent to which a given volume of air effects the temperature within the module. Furthermore, even as it is used in connection with radiative heating and cooling systems, this method is intrinsically inequitable, since it only gives the appearance of prorating the total operating cost on the basis of the energy used by each tenant. The various well known factors which adversely influence the efficiency of radiative heat exchangers make the comparison of heat gained or lost through the tenants' radiators practically meaningless.

BRIEF SUMMARY OF THE INVENTION

My approach to the problems described above has been to eliminate most of the variables and complexities by applying two simplifying concepts:

1. The principal system parameters should be held constant. That is, the system should be operated at a fixed manifold temperature and pressure, so that there is only a single variable (namely, air-volume flow) accommodating the different temperature and power demands of the different tenants.

2. It should be recognized that tenants do not require an absolutely accurate proportionality between cost allocation and power consumption. This is so because many of the factors causing variability of power use are very subjective, or at least not directly comparable in quantitative ways.

This second point bears some elaboration. As an example, a tenant who prefers to keep his area very cold expects to pay more for cooling than his neighbor who keeps his area at a more customary temperature, all other things being equal. However, the tenant who prefers a very cold area might not continue to approve if that neighbor also happened to keep a large outside door open all day. The cold-area tenant expects to see some compensating effect in the cooling cost allocation for his neighbor's open door. But he is not able to compare in any quantitative way the effects of his own preference for cold with his neighbor's preference for an open door, so if there is some strong tendency in the allocation mechanism to make allowances for these two incommensurable preferences, he is satisfied.

Similarly, both of these tenants will be satisfied with a cost allocation mechanism which makes allowance for a third tenant's nearby operation which generates a great heat load within his area. For example, if the third tenant has a large number of physically active people in his premises all day, with bright lights and perhaps a cooking facility, the first two tenants would justifiably expect to see some qualitatively reasonable compensation for these characteristics, in the cost allocation for cooling.

They must all believe, of course, that if they were to close their doors, remove all but one or two people, cease strenuous physical activity, turn off all special equipment and equalize their room temperatures, the cost allocating mechanism would generate values roughly proportional to square footage, or outside frontage, or the like. This characteristic of the system should in fact be demonstrable.

My system makes use of the two simplifying concepts stated above. In accordance with this invention, the volume of air flowing into each area module is continuously monitored by independent metering equipment associated with each module, and the cumulative volume of air received by each module is ascertained. This is the only measurement made for the individual area. No effort is made, and indeed it is not necessary, to measure the input temperature, or to correct for the air pressure or temperature at the flow meter, for these parameters are substantially constant throughout the distribution system, and therefore simply cancel out of the rough proportionality equations. Likewise, no effort is made to measure the return flow volume or temperature, for in the majority of cases such measurements would produce only a relatively small correction. As will be mentioned later, there may be an exception in the case of a module having an exterior door open over a long period of time, however, this is a relatively infrequent occurrence and may or may not warrant special treatment, depending upon the circumstances. In any event, the proration of operating costs is accomplished by comparing the total volume of air used by each of the units with the total volume of air used by all of the units during any given period, as, for example, during each month. The total volume used by all of the units may be measured by providing metering means at the central delivery system to register the total volume of air put out by it during a given period, or may be approximated, without need for the use of additional metering equipment by taking the sum of the volumes of air received by all of the units during that period.

There are basically two alternative approaches to using the information obtained from this system, in calculating the cost to be allocated to each area module. The simpler approach is to make the cost allocation directly proportional to the cumulative air volume used. This approach, while simple, tends to be somewhat unfair to the heavier-use tenants in that it allocates the fixed component of the system cost in proportion to usage. That is, the initial cost of purchase and installation, as well as the fixed component of operating cost, is treated as dependent upon the volume of cooled or heated air used. Heavier-use tenants would be entitled to find this somewhat inequitable, inasmuch as the equipment is present and operating whether a particular neighbor tenant chooses to make use of it or not, and it can be argued persuasively that the base costs of that equipment should be in effect part of the rent, that is, distributed in proportion to square footage or frontage, with only the superimposed varying component of cost allocated in direct proportion to volume flow rate.

Of course a single, relatively simple, computer and program can make these calculations by whichever approach is preferred, or by a hybrid method which distributes part but not all of the fixed system cost in proportion to volume use. The computer can also print out records showing the volume flow, the various dollar equivalences, and the total apportioned cost, for each tenant.

The principles and features introduced above, and their advantages, may be more fully understood from the detailed disclosure hereunder, with reference to the accompanying drawing, which is described in the following paragraph.

BRIEF DESCRIPTION OF THE DRAWING

The single drawing of this specification is a schematic cross-sectional elevation of a building having multiple independent area modules. An air cooling or heating system in accordance with my invention is schematically shown installed therein.

DESCRIPTION OF PREFERRED EMBODIMENTS

A building such as is appropriate for practice of my invention is typically characterized by outer walls 11, roof 12, and interior area modules 16*a*, 16*b*, 16*c*, and 16*d*, as well as public areas 16*e* used in common by the tenants of the area modules and their guests. Interior walls 17 separate the area modules from the common public areas. Each area has floors 14, and ceilings 13 concealing utilities from view of the occupants of the various areas.

Mounted in some convenient location, as for example on the roof 12, is a heat-transfer device 21. This may be a heating-or cooling-only unit, a combination of heating and cooling units, or a single unit, such as a heat pump, providing both heating and cooling functions. However, in my system it is required that only a refrigerative or a heating device (and not both) be available for use at any one time, or else a completely separate distribution and return system must be provided for the second device.

Mounted near the heat-transfer device 21 is a blower 22 which draws air from the return mainfold 37 through the heat-transfer device 21 and impels the air through a pressure controller 23 to the distribution manifold 24.

The pressure controller 23 stabilizes the static pressure in the distribution manifold 24, by sending a control signal 27 to vary the speed of blower 22, or, in the alternative, by operating variable discharge dampers (not shown) or inlet vanes (not shown) at appropriate points in the system.

The thermostat 25 stabilizes the temperature of air in the distribution manifold 24, by sending a control signal 26 to vary the duty cycle or some other appropriate operating parameter of the heat-transfer device 21.

Both the pressure controller 23 and thermostat 25 are essential to attainment of consistent power-cost allocation from day to day. They cause the individual area controllers and meters (described below) to behave consistently even while external ambient conditions, as well as internal activities and conditions, fluctuate drastically. In addition, these same two units, and particularly the thermostat, function to hold the power consumption of the central system approximately equal to the sum of the power requirements for heating or cooling the individual area modules. That is, the central system is automatically throttled back as total tenant demand decreases.

The distribution manifold 24 consists of ductwork which conveys the nominally constant-pressure, constant-temperature air to each of the individual tenant areas 16*a* through 16*d*, and as well to the common public areas such as 16*e*. For simplicity, the distribution duct systems have been drawn only to two of the tenant areas, 16*c* and 16*d*, and to the central public area 16*e*.

Each of the distribution manifold 24 ducts terminates in a variable valve 33*c*, 33*d* or 33*e*, under control of a respective area thermostat 31*c*, 31*d* or 31*e*, by a control signal 32*c*, 32*d*, 32*e* which acts upon the valve to increase or decrease the volume of air flow therethrough so as to stabilize the temperature in the respective area 16*c*, 16*d*, 16*e* at the value set on the thermostat.

The polarity of the thermostat action, that is, whether it opens or closes the valve when the room temperature exceeds the control temperature, must be reversed whenever the heat-transfer device 21 is changed between heating and cooling. This may be accomplished automatically by signal connections from the device 21 to each thermostat 31*c*, 31*d*, 31*e*; or by manual switches on each thermostat.

For an accurate determination of the volume of air put out by the central distribution system, a flowmeter 34' is located in the distribution manifold 24 or some other convenient location in or adjacent to heat-transfer device 21, blower 22 or manifold 24. The volume of air flow into each area module is monitored by flow meters 34*c*, 34*d*, 34*e* in the branch of the duct delivering air from the central system to the respective module. These flowmeters may be located upstream of valves 33*c*, 33*d*, 33*e*, or between those valves and outlets 35*c*, 35*d*, 35*e* to the respective modules. Flowmeters 34', 34*c*, 34*d*, 34*e* may be of any suitable design.

Flow signals 39', 39*c*, 39*d*, 39*e* from the respective meters may then be directed to central utilization means 38, which if desired may be located in an area 16*e* convenient to building management personnel. Utilization means 38 may take the form of any accumulative counter for the central distribution system output and each area module, and if desired, a computer to perform arithmetic functions on the accumulated information as mentioned earlier. Alternatively, if preferred, each meter may have its own local accumulator and register, which is read periodically by meter-reading personnel who must go through the building to take the readings.

Air flow is returned to the central heat-transfer device 21 via individual return grills such as 36*c* and 36*d* and such additional grills (not shown) as are required in the other tenant areas 16*a*, 16*b* and the public area 16*e*, and through return manifold 37.

Ducting 24 and 37, valves 33, meters 34 and signal connections 32 and 39 can all of course be concealed with other utilities above ceilings 13 or within walls 17 or 11.

Because each tenant's volume usage of air is metered, each tenant can independently observe the cost effects of changing his thermostat setting or of other heat-related practices such as keeping doors open, using high or low levels of lighting, or operating other heat-dissipating equipment in his area. This naturally produces incentive to use conservative practices; but to the extent the incentive is not heeded by a particular tenant the cost effects upon other tenants are usually minimal or negligible.

If a particular tenant keeps large doors open to the common public area, little or no inaccuracy of cost apportionment results, for the consequence in most cases will simply be that a large fraction of the air supplied to his establishment will be returned via the public area. Even if the doors lead to the outside of the building, the result will be the same, provided that the ambient outside air temperature is not too different from the temperature in the return manifold 37.

On the other hand if large doors are open to the outside weather, and the outside air is at a substantially different temperature from the air in the return duct, then the tenant responsible for the waste may not be paying his fair share, and such a practice should be discouraged.

Because the central, common heat-transfer device 21 as well as the blower 22 is throttled back with falling tenant demand, the cost of operation of the entire system nominally tracks the sum of the tenant demands. The "throttling-back" function applied to device 21 may be advantageously controlled in a number of ways, as for example in response to (1) the velocity of blower 22, or the volume of air flowing therethrough; or (2) the temperature differential between the air in the return duct and the air in the distribution manifold; or (3) a combination of these two parameters.

In some situations, as for example in large installations in which a substantial portion of the output of the central system is utilized to cool or heat public areas and common spaces, it may be more equitable to prorate the tenants' share of the operating cost of the central system on the basis of the volume of air actually utilized by all of the tenants, rather than the volume used by the entire complex. In such cases, in lieu of comparing the reading of each of the module's meters 34*c*, 34*d*, 34*e* with the cumulative reading of meter 34', utilization means 38 would be programmed to compare flow signals 39*c*, 39*d*, 39*e* with the aggregate volume determined by summing signals 39*c*, 39*d*, 39*e* for the billing period. Meter 39*a* would then be unnecessary.

It will be understood that the foregoing disclosure is exemplary only, and is not to be construed as limiting the scope of the invention, which is to be ascertained only by reference to the appended claims.

I claim as my invention:

1. In combination with a system for controlling the temperature in each of a plurality of area modules in a building, said system including regulatable heat-transfer means common to all of said modules for adjusting the temperature of air to a preset value, air conveyance ducts connected between said heat-transfer means and each of said modules, air impelling means impelling air through said heat-transfer means and into said ducts, and, associated with each of said modules, separate, independently operable valve means in the duct between said heat-transfer means and said module for varying the volume of air flowing from said heat-transfer means into said module and separate, selectively operable thermostat means for sensing the temperature of air in said module and for controlling said valve means in response to variations of said temperature from a preset value, means for determining the relative amount of energy consumed in controlling the temperature in each of said modules with respect to the total amount of energy consumed in controlling the temperature in all of said modules, comprising:

first means for ascertaining the cumulative volume of such air attributable to all of said modules during a given period; and second, separate, independent means associated with each module for measuring and registering the cumulative volume of such air flowing into each said module during said period for comparison with the said cumulative volume of such air attributable to all of said modules during said period.

2. The energy consumption-determining means of claim 1, wherein:

said second means include meter means responsive to the passage of air from said heat-transfer means into said module, positioned in the duct between said heat-transfer means and each of said modules.

3. The energy consumption-determining means of claim 2, wherein:

said first means includes means for registering the sum of the said cumulative volumes of such air flowing into all of said modules during said period.

4. The energy consumption-determining means of claim 2, wherein:

said first means includes meter means associated with said heat-transfer means and responsive to the passage of air through said heat-transfer means, for measuring the cumulative volume of such air passing through said heat-transfer means during said period.

5. The energy consumption-determining means of claim 2, comprising means for comparing the cumulative volume of such air flowing into each module during said period with the cumulative volume of air attributable to all of said modules during said period.

6. The energy consumption-determining means of claim 5, comprising:

separate, independent meter means responsive to the passage of air from said heat-transfer means into said module, positioned in the duct between said heat-transfer means and each of said modules, for generating an output signal related to the volume of such air received by said module; and utilization means, including computer means, for receiving said output signals, summing the respective cumulative volumes of such air received by each of said modules, comparing the cumulative volume of such air received by each module with the sum of the cumulative volumes of such air received by all of said modules, and producing from such comparison a reading related in a predetermined manner to the cumulative volume of such air delivered by said temperature controlling system to all of said modules.

7. The energy consumption-determining means of claim 5, comprising:

first meter means associated with said heat-transfer means and responsive to the passage of air through said heat-transfer means, for generating an output signal related to the volume of such air passing through said heat-transfer means; and second, separate, independent meter means responsive to the passage of air from said heat-transfer means into said module, positioned in the duct between said heat-transfer means and each of said modules, for generating an output signal related to the volume of such air received by said module;

utilization means, including computer means, for receiving said output signals, comparing the cumulative volume of such air received by said module with the cumulative volume of such air passing through said heat-transfer means, and producing from such comparison a reading related in a predetermined manner to the cumulative volume of such air passing through said heat-transfer means.

8. A method for apportioning the cost of operating variable-volume air distribution temperature control equipment among independent use areas in a building, comprising:

distributing air from a common source to all such use areas at preset temperature, but a volume flow rate which is independently variable with respect to each such use area on demand as determined partly by the differential between actual and desired temperatures in each such use area;

monitoring the volume flow and thereby ascertaining the cumulative volume flow to each such use area;

determining the total cumulative volume flow to all such use areas; and prorating the total cost of operating said equipment among all such use areas in proportion to the ratio of the cumulative volume flow to each such use area to the cumulative volume flow to all such areas.

9. A method for apportioning the cost of operating variable-volume air distribution temperature control equipment among independent use areas in a building, comprising:

distributing air from a common source to all such use areas at preset temperature, but at volume flow rate which is independently variable with respect to each such use area on demand as determined partly by the differential between actual and desired temperatures in each such use area;

monitoring the volume flow from said common source and the volume flow to each such use area;

determining the cumulative volume flow from said common source and the cumulative volume flow to each such use area; and prorating the total cost of operating said equipment among all such use areas in proportion to the ratio of the cumulative volume flow to each such use area to the cumulative volume flow from said common source.

* * * * *